US010204459B1

(12) United States Patent
Martin et al.

(10) Patent No.: US 10,204,459 B1
(45) Date of Patent: Feb. 12, 2019

(54) AUTOMATED TOLL PAYMENTS USING VEHICLE AND TOLL ROUTE TRACKING

(71) Applicant: Verizon Patent and Licensing Inc., Arlington, VA (US)

(72) Inventors: Angela L. Martin, Atlanta, GA (US); Atul Suri, Alpharetta, GA (US); Gregory Robert Shrader, Roswell, GA (US); Mourya C. Darivemula, Sugar Hill, GA (US)

(73) Assignee: Verizon Patent and Licensing Inc., Basking Ridge, NJ (US)

( * ) Notice: Subject to any disclaimer, the term of this patent is extended or adjusted under 35 U.S.C. 154(b) by 0 days.

(21) Appl. No.: 15/707,020

(22) Filed: Sep. 18, 2017

(51) Int. Cl.
*G08G 1/01* (2006.01)
*G07B 15/06* (2011.01)
*G08G 1/0967* (2006.01)

(52) U.S. Cl.
CPC ..... *G07B 15/063* (2013.01); *G08G 1/01* (2013.01); *G08G 1/096783* (2013.01)

(58) Field of Classification Search
CPC ..... G07B 15/00; G07B 15/02; G07B 15/06; G07B 15/063; G08G 1/01; G08G 1/0104; G08G 1/0137; G01C 21/26; G01C 21/28; G01C 21/34; G01C 21/3407
See application file for complete search history.

(56) References Cited

U.S. PATENT DOCUMENTS

| | | | | |
|---|---|---|---|---|
| 7,990,286 | B2 * | 8/2011 | Shankwitz | G01C 21/26 340/435 |
| 9,595,139 | B1 * | 3/2017 | Breed | G07B 15/063 |
| 9,691,188 | B2 * | 6/2017 | Breed | G07B 15/00 |
| 2012/0215594 | A1 | 8/2012 | Gravelle | |
| 2016/0034845 | A1 * | 2/2016 | Hiyama | G06Q 10/063114 705/7.15 |
| 2016/0140872 | A1 * | 5/2016 | Palmer | G06K 9/00791 434/65 |
| 2017/0127230 | A1 * | 5/2017 | Enriquez | G06Q 20/40145 |

* cited by examiner

*Primary Examiner* — Van T Trieu

(57) ABSTRACT

A network device receives a vehicle coordinate report from a vehicle transiting a toll-way, wherein the report includes current geographic coordinates of the vehicle. The network device determines a distance to a current toll station (DTT) of the toll-way based on the current geographic coordinates of the vehicle, and determines a cumulative distance (CD) traveled by the vehicle on the toll-way based on the current geographic coordinates of the vehicle. The network device triggers assessment of a toll charge to a customer associated with the vehicle based on the determined distance DTT and the determined cumulative distance CD.

20 Claims, 9 Drawing Sheets

AUTOMATED TOLL PAYMENTS USING VEHICLE AND TOLL ROUTE TRACKING

BACKGROUND

Toll roads, also called toll-ways or turnpikes, include roads for vehicles for which a toll fee is assessed to the vehicle for passage through the toll roads. Toll roads typically have one or more toll stations over the course of the toll roads, at each of which an additional toll fee is applied to the transiting vehicle. Historically, each toll station included at least one payment booth at which vehicles transiting the toll road paid the toll fee before continuing to transit the remainder of the toll road. Lengthy toll roads may include numerous toll stations spaced apart along the course of the toll road, and also may include a toll station at each exit off of the toll road.

DETAILED DESCRIPTION OF THE PREFERRED EMBODIMENTS

The following detailed description refers to the accompanying drawings. The same reference numbers in different drawings may identify the same or similar elements. The following detailed description does not limit the invention, which is defined by the claims.

Exemplary embodiments described herein enable the automated assessment of toll charges to vehicles transiting toll-ways based on the tracking of geographic coordinates of the vehicles. Each of the vehicles includes a wireless device, with geo-location determining capability, which determines current geographic coordinates of the vehicles as they move through the toll-way, and reports those geographic coordinates via a wireless network. A telematics device receives the current geographic coordinates reported by the vehicles, and tracks the vehicles relative to one or more toll stations along the respective toll-ways through which each vehicle is traveling. By tracking the movement of each vehicle relative to the one or more toll stations within the toll-ways, the telematics device, in cooperation with other devices, may automatically assess toll charges to the customers associated with the vehicles, and automatically extract customer payment for the assessed toll charges.

Figure 1:
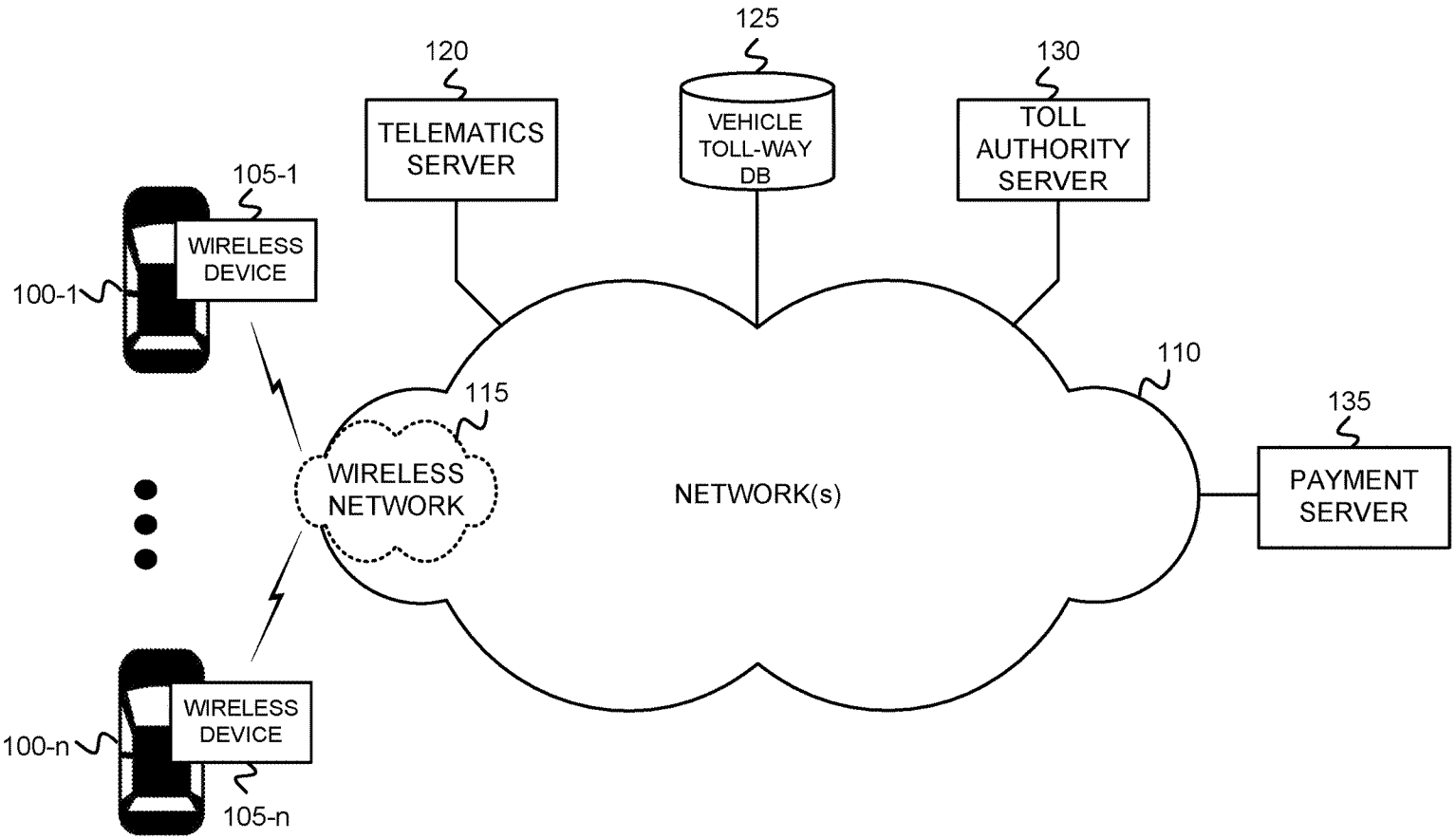
FIG. 1 illustrates an exemplary network environment in which vehicle and toll route tracking are used to automatically apply toll charges to customers traveling within vehicles along toll-ways.

FIG. 1 illustrates an exemplary network environment 100 in which vehicle and toll route tracking are used to automatically apply toll charges to customers traveling within vehicles along toll-ways. Network environment 100 includes vehicles 100-1 through **110-*n*, each associated with a respective one of wireless devices 105-1 through 105-*n*; a wireless network 115 that may be connected to, or a component of, another network(s) 110; a telematics server 120; a vehicle toll-way database (DB) 125; a toll authority server 130; and a payment server 135**.

Wireless devices 105-1 through **105-*n* (generically referred to herein as "wireless devices 105" or "wireless device 105") may each include any type of electronic device that includes a wireless communication interface for communicating with wireless network 115 via a wireless connection, and also includes a geo-location determining device that is capable of determining the current geographic coordinates of device 105. In some implementations, the geo-location determining device of wireless devices 105 may include a Global Positioning System (GPS) device that uses a satellite GPS network to determine the geographic position of the wireless devices 105**.

Wireless devices 105-1 through **105-*n* may each include an electronic device that is carried by an owner, operator, and/or a permanent or temporary user of the device 105 while driving and/or riding within a vehicle 100; may each include an "on-board diagnostics" device (OBD) that is a component of a vehicle 100; and/or may each include a geo-location determining, navigational device that may be connected to, and disconnected from, the systems of vehicle 100 through the actions of the user of the device (e.g., a GPS dongle, or an "after-market" GPS navigation device). Wireless devices 105 may execute an application (app) that performs various geo-location functions, in conjunction with, for example, a GPS device. In circumstances where wireless devices 105 includes an electronic device that is carried by an owner, operator, and/or a permanent or temporary user of the device, wireless devices 105** may each include, for example, a cellular telephone; a "smart" phone; a personal digital assistant (PDA); a wearable computer; a desktop, laptop, palmtop or tablet computer; or a media player that has geo-location determining and communications capability.

Wireless network 115 includes one or more wireless networks including, for example, one or more public land mobile networks (PLMNs), and/or one or more satellite mobile networks. The PLMN(s) may include, for example, a Code Division Multiple Access (CDMA) 2000 PLMN, a Global System for Mobile Communications (GSM) PLMN, a Long Term Evolution (LTE) PLMN and/or other types of PLMNs (e.g., such as a fourth-generation (4G) LTE network, or a fifth-generation (5G) LTE network).

Network(s) 110 may include one or more networks of various types including, for example, a telecommunications network (e.g., Public Switched Telephone Networks (PSTNs)), the Internet, a wired and/or wireless local area network (LAN), a wired and/or wireless wide area network (WAN), a metropolitan area network (MAN), an intranet, or a cable network (e.g., an optical cable network).

Telematics server 120 includes one or more network devices that receive reports from wireless devices 105, the reports including geographic coordinates, vehicle/customer identification information, and/or vehicle information, and analyze the reported geographic coordinates to track the respective vehicles 100 along a toll-way relative to one or more toll stations located along the toll-way. A "toll station" refers to a particular point along a toll-way at which a toll charge is to be assessed to vehicles stopping at, driving by, or passing through, that particular point along the toll-way. A "toll station" may include an automated or manned physical toll booth, or may include a virtual "way point" along the toll-way at which a toll charge is applied to a vehicle or customer that drives by or passes through the way point. Geographic coordinates (e.g., latitude and longitude) may be associated with each toll station, such as, for example, geographic coordinates associated with a way point of a toll station. Each toll-way may include one or more toll stations for assessing one or more toll charges to each vehicle/customer as the vehicle/customer passes by or drives through each of the one or more toll stations. Telematics server 120 automatically triggers assessment of toll charges to customers associated with the wireless devices 105 based on the toll-way vehicle tracking.

Vehicle toll-way DB 125 includes a data structure that stores vehicle coordinate data, and other data, received from wireless devices 105 associated with respective vehicles 110. Details of an exemplary implementation of the data structure of DB 125 is illustrated and described below with respect to FIG. 3.

Toll authority server 130 includes one or more network devices that provide toll station geographic coordinates for one or more toll-ways, and provide toll rates to be charged to vehicles 100 traveling via the one or more toll-ways. The toll rates may include, for example, a particular toll rate to be assessed at each particular toll station along the toll-way, with possible different toll rates based on the time of day, the time of year, a particular period of time, the type of the vehicle 100, the weight of the vehicle 100, and/or the number of axles of the vehicle 100.

Payment server 135 includes one or more network devices that apply toll charges to accounts of customers to extract payment from the customers. Each customer may have an established account, including a designated payment source (e.g., credit card, debit card, bank account, etc.), to which toll charges are applied, and payment server 135 extracts the applied toll charge from the customer's designated payment source.

The configuration of the components of network environment 100 depicted in FIG. 1 is for illustrative purposes only, and other configurations may be implemented. Therefore, network environment 100 may include additional, fewer and/or different components, that may be configured differently, than depicted in FIG. 1.

Figure 2:
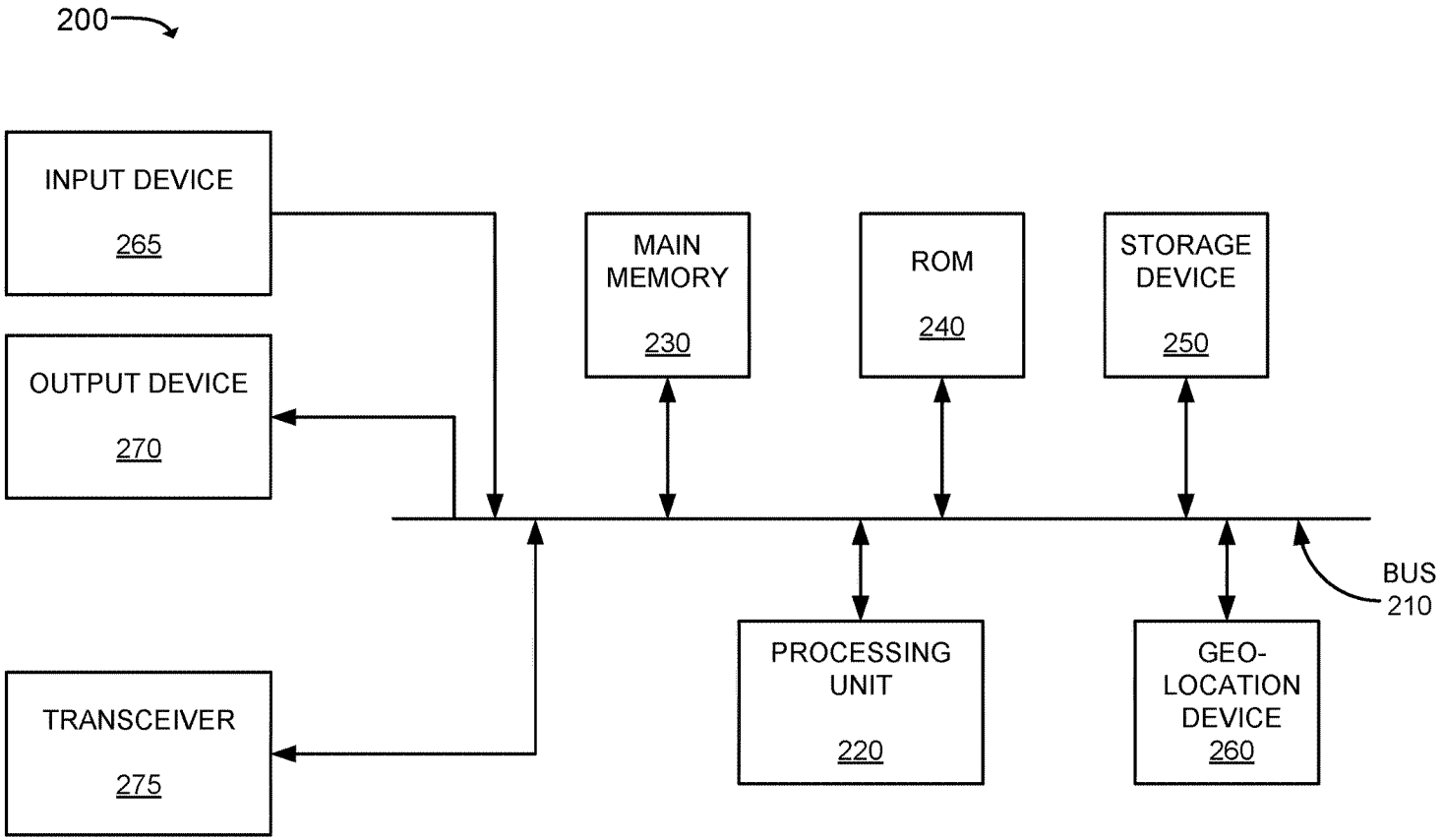
FIG. 2 is a diagram that depicts exemplary components of a device that may correspond to the wireless device, telematics server, toll database, toll authority server, and payment server shown in FIG. 1.

FIG. 2 is a diagram that depicts exemplary components of a device 200. Wireless device 105, telematics server 120, vehicle toll-way DB 125, toll authority server 130, and payment server 135 may each include a device(s) configured similarly to device 200 shown in FIG. 2, possibly with some variations in components and/or configuration. Device 200 may include a bus 210, a processing unit 220, a main memory 230, a read only memory (ROM) 240, a storage device 250, a geo-location device 260, an input device 265, an output device 270, and a transceiver 275.

Bus 210 includes a path that permits communication among the components of device 200. Processing unit 220 may include one or more processors or microprocessors, or processing logic (e.g., circuitry), which may execute instructions. Main memory 230 may include a random access memory (RAM) or another type of dynamic storage device that may store information and instructions for execution by processing unit 220. ROM 240 may include a ROM device or another type of static storage device that stores static information and instructions for use by processing unit 220. Storage device 250 may include a magnetic, flash memory, and/or optical recording medium. Main memory 230, ROM 240 and storage device 250 may each be a "tangible and/or non-transitory computer-readable storage medium."

Geo-location device 260 includes a device that determines a geographic location of device 200. In one implementation, geo-location device 260 includes a Global Positioning System (GPS) device that determines, using a GPS satellite system, geographic coordinates of device 200. The geographic position of device 105 may be tracked over time to determine a velocity and/or a heading of device 200 such as, for example, when device 200 is disposed within a moving vehicle 100.

Input device 265 may include one or more mechanisms that permit an operator to input information to device 200, such as, for example, a keypad or a keyboard, a display with a touch sensitive panel, voice recognition and/or biometric mechanisms, etc. Output device 270 may include one or more mechanisms that output information to the operator or user, including a display (e.g., with a touch sensitive panel), a speaker, etc. Input device 265 and output device 270 may be implemented as a graphical user interface (GUI) (e.g., a touch screen GUI that uses any type of touch screen device) that displays GUI information and which receives user input via the GUI.

Transceiver 275 may include one or more transceivers (e.g., transmitters and/or receivers) that enable device 200 to communicate with other devices and/or systems. For example, transceiver 275 may include a wireless transceiver for communicating via wireless network 115.

The configuration of components of device 200 shown in FIG. 2 is for illustrative purposes. Other configurations may be implemented. Therefore, device 200 may include additional, fewer and/or different components, arranged in a different configuration, than depicted in FIG. 2. For example, telematics server 120, vehicle toll-way DB 125, toll authority server 130, and payment server 135 may include the same, or similar components, to those shown in FIG. 2, but may omit geo-location device 260.

Figure 3:
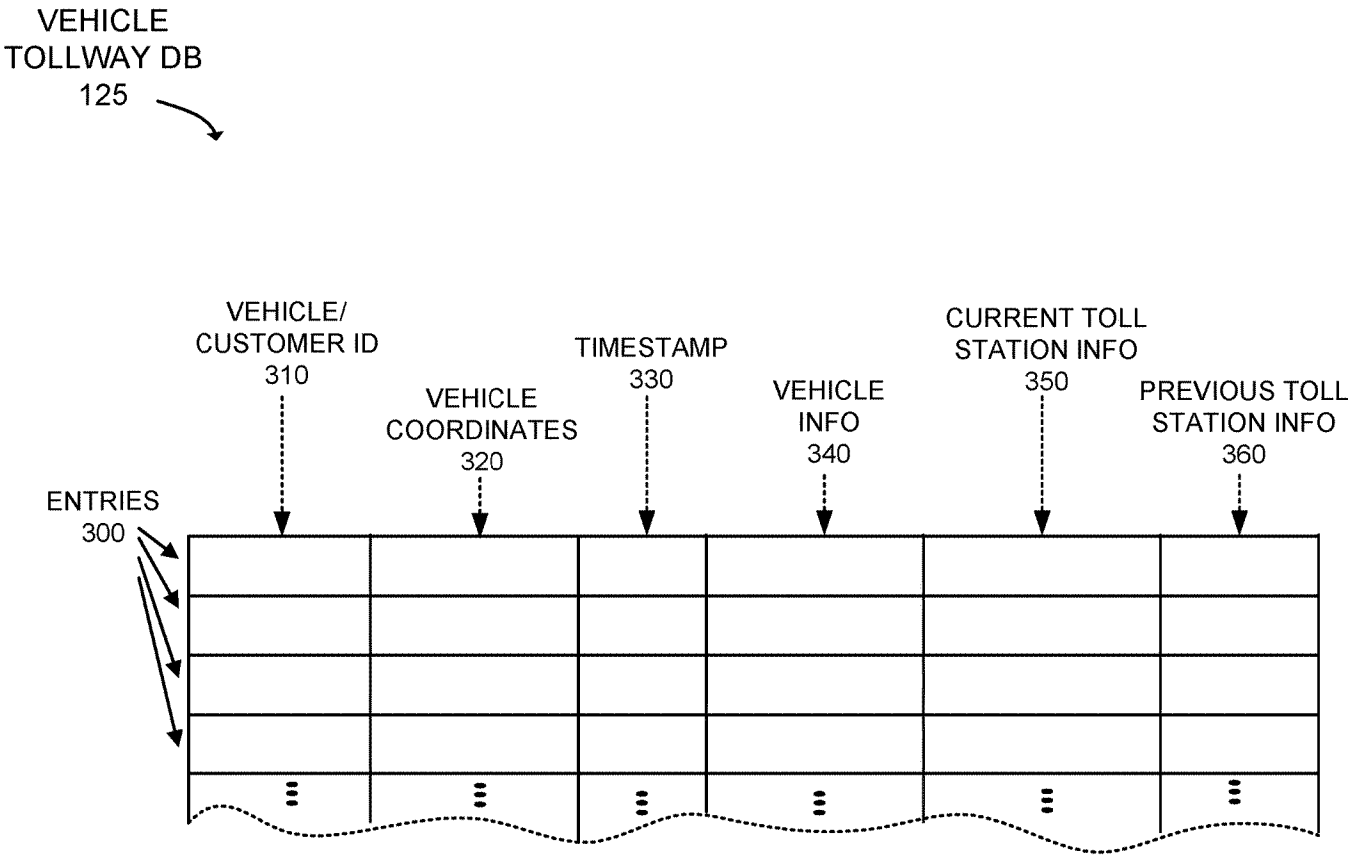
FIG. 3 is a diagram that depicts an exemplary implementation of the toll database of FIG. 1.

FIG. 3 is a diagram that depicts an exemplary implementation of vehicle toll-way DB 125. As shown, a data structure of vehicle toll-way DB 125 may include multiple entries 300, with each entry 300 including a vehicle/customer ID field 310, a vehicle coordinates field 320, a timestamp field 330, a vehicle information field 340, a current toll booth information field 350, and a previous toll booth information field 360.

Vehicle/customer ID field 310 stores a globally unique identifier (GUID) associated with a vehicle 100, and/or a customer driving, or riding in a vehicle 100. Vehicle coordinates field 320 stores one or more geographic coordinates of a vehicle 100 associated with the vehicle 100 transiting through a toll-way. Field 320 may only store a number of the most recent geographic coordinates of the vehicle 100, or may store an entire sequence of geographic coordinates of the vehicle 100 as the vehicle transits across the toll-way (e.g., from toll-way entrance to toll-way exit).

Timestamp field 330 stores one or more timestamps associated with one or more respective geographic coordinates. When a current geographic coordinate of vehicle 100 is determined by wireless device 105, device 105 obtains a current date and time and uses as a timestamp for the geographic coordinate.

Vehicle information field 340 stores information about the vehicle 100 identified in field 310, or that is associated with the customer identified in field 310. The vehicle information may include, for example, a vehicle type (passenger, commercial, government, etc.), a number of axles that the vehicle 100 has (e.g., 2, 4, 8, etc.), and/or a weight of the vehicle 100.

Current toll station information field 350 stores, for example, geographic coordinates, a toll station mile marker, and a toll station name associated with a current toll station for the vehicle identified in field 310, or with a vehicle associated with the customer identified in field 310. A "current toll station" includes a toll station within a toll-way towards which the vehicle is driving, but has not yet driven by or through.

Previous toll station information field 360 stores geographic coordinates, a toll station mile marker, and a toll station name associated with a previous toll station for the vehicle identified in field 310, or with a vehicle associated with the customer identified in field 310. A "previous toll station" includes a toll station within a toll-way that the vehicle 100 most recently has driven by/through, but is now proceeding towards the toll station identified in field 350.

To locate a particular entry of toll DB 125, DB 125 may be queried with, for example, a vehicle/customer ID to locate an entry 300 having a matching vehicle/customer ID field 310. When such an entry 300 is located, data may be stored in one or more fields 320, 330, 340, 350, and/or 360 of the entry 300, or data may be retrieved from one or more fields 320, 330, 340, 350, and/or 360 of the entry 300. Other fields of an entry 300, instead of vehicle/customer ID field 310, may alternatively be used for querying DB 125.

Vehicle toll-way DB 125 is depicted in FIG. 3 as including tabular data structures with certain numbers of fields having certain content. The tabular data structure of DB 125 shown in FIG. 3, however, is for illustrative purposes. Other types of data structures may alternatively be used. The number, types, and content of the entries and/or fields in the data structures of DB 125 illustrated in FIG. 3 is also for illustrative purposes. Other data structures having different numbers of, types of and/or content of, the entries and/or the fields may be implemented. Therefore, vehicle toll-way DB 125 may include additional, fewer and/or different entries and/or fields than those depicted in FIG. 3.

Figure 4:
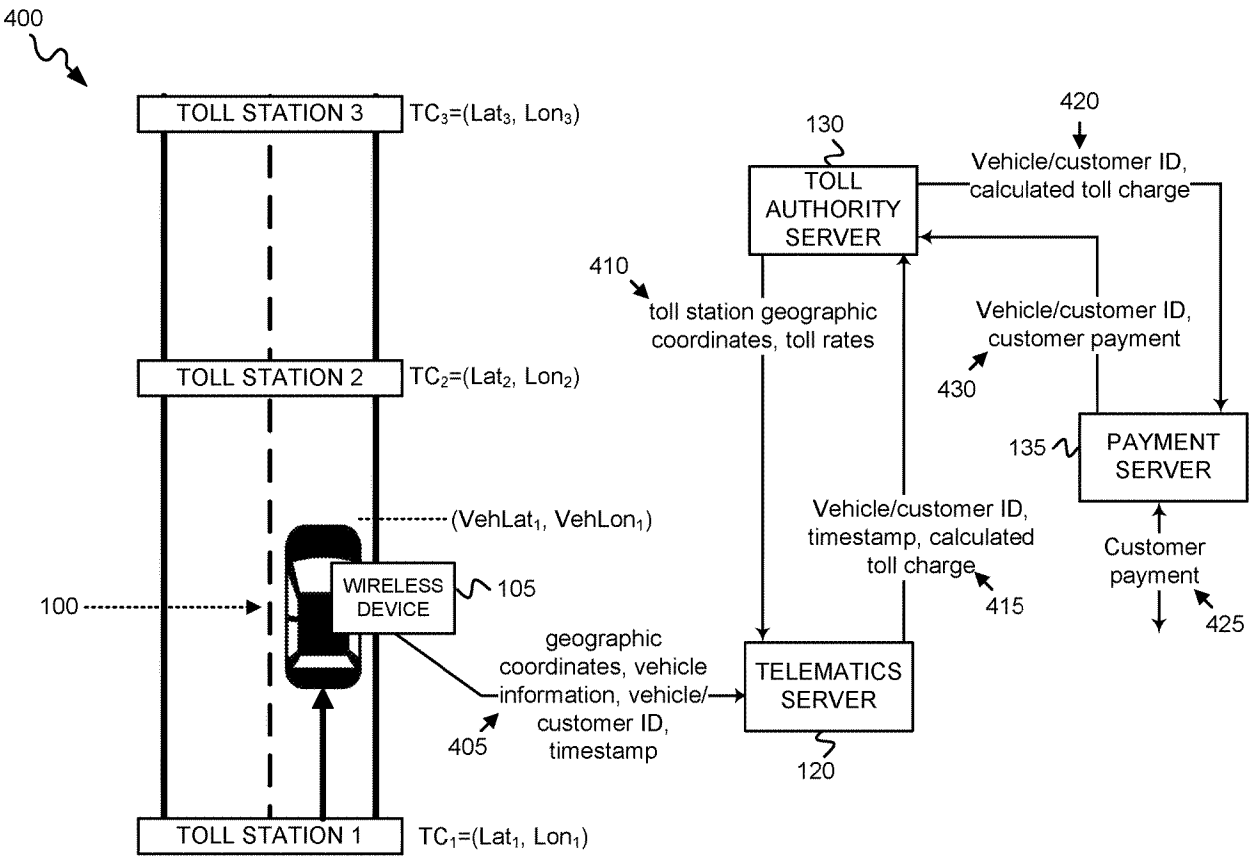
FIG. 4 depicts a vehicle traveling a toll-way, and the use of the wireless device of FIG. 1 for determining vehicle coordinates of the vehicle and reporting the vehicle coordinates for toll-way tracking.
Figure 5A:
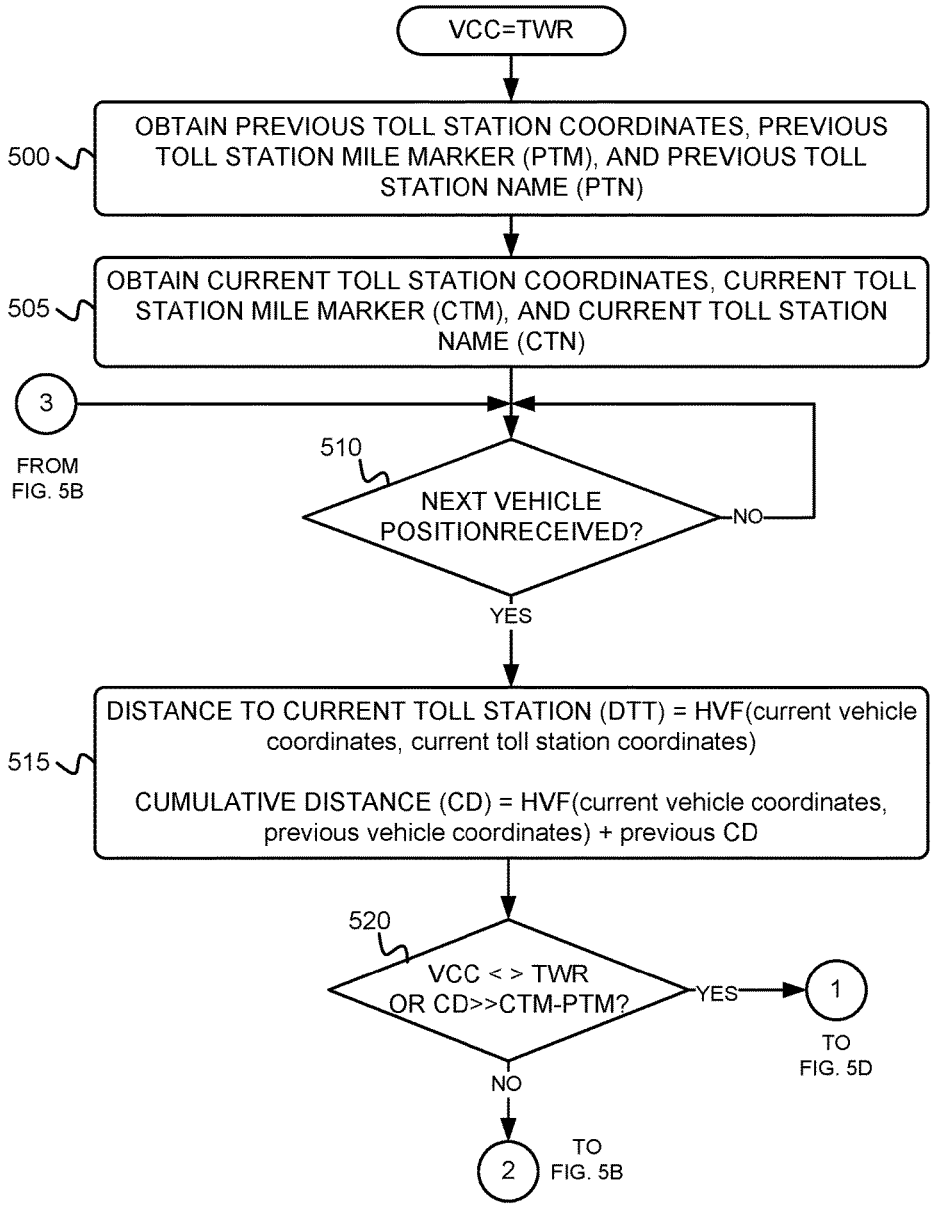
FIGS. 5A-5D are flowcharts that illustrate an exemplary process for tracking a geographic position of a vehicle, comparing the position with toll station geographic coordinates of a toll-way, and triggering vehicle toll charges based on the position comparison.
Figure 5B:
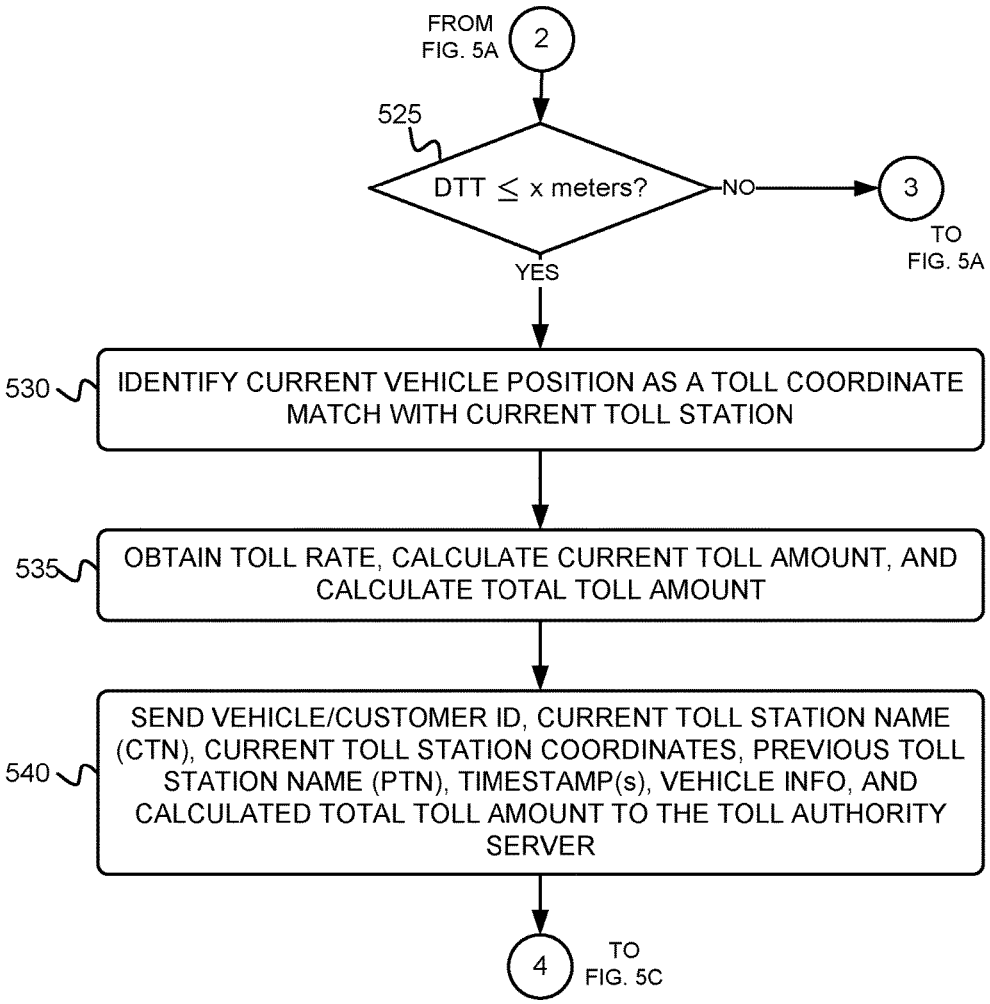
Figure 5C:
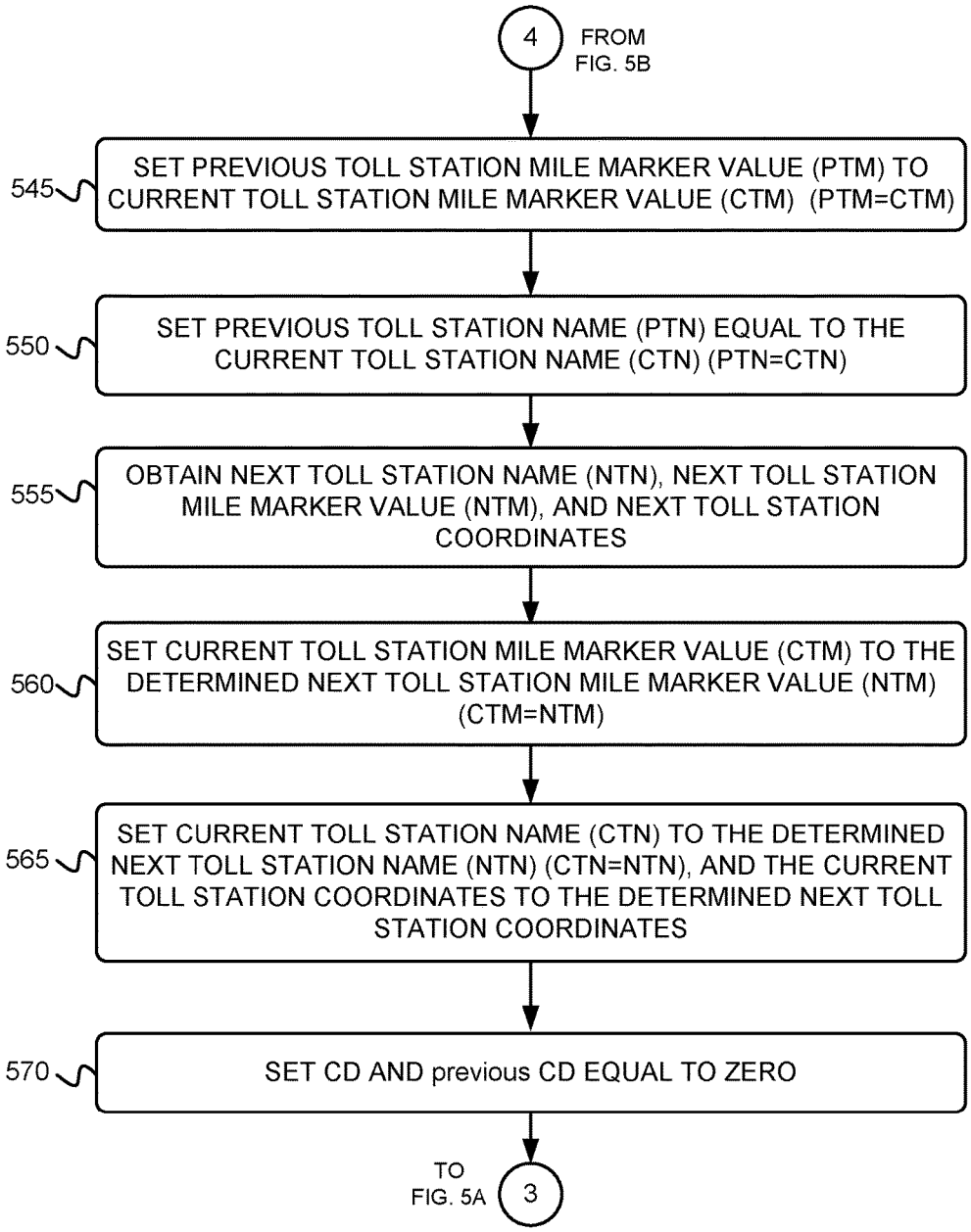
Figure 5D:
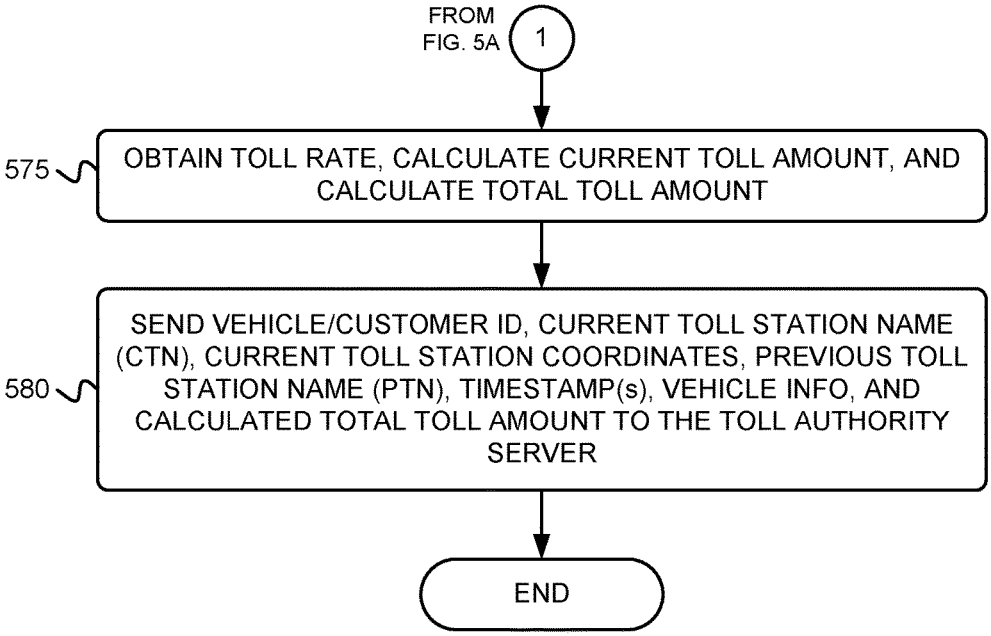

FIG. 4 depicts a vehicle 100 traveling a toll-way 400, and the use of wireless device 105 for determining vehicle coordinates of vehicle 100, and reporting the vehicle coordinates for toll-way tracking. As shown, as vehicle 100 transits between the toll stations (toll station 1, toll station 2, toll station 3) of toll-way 400, a wireless device 105 associated with vehicle 100 determines current geographic coordinates ($VehLat_1$, $VehLon_1$) of wireless device 105 and vehicle 100, and transmits a report 405 to telematics server 120 that includes the current geographic coordinates of vehicle 100. The report sent to telematics server 120 may include, for example, the current vehicle coordinates, vehicle information (e.g., vehicle type, vehicle axle information, vehicle weight), a vehicle/customer ID, and a timestamp. The timestamp includes date and time information associated with the moment the current geographic coordinates were determined by wireless device 105.

As further shown in FIG. 4, toll authority server 130 sends 410 pre-determined geographic coordinates ($TC_1=Lat_1$, $Lon_1$; $TC_2=Lat_2$, $Lon_2$; $TC_3=Lat_3$, $Lon_3$), and associated toll rates, for each of the toll stations along toll-way 400 to telematics server 120. Based on the pre-determined geographic coordinates of the toll stations along toll-way 400, and the wireless device 105's current reported geographic coordinates, telematics server 120 may track vehicle 100's position relative to each toll station in toll-way 400, and determine when vehicle 100's coordinates match the position of each toll station so as to trigger the assessment of an appropriate toll charge for that particular toll station. Telematics server 120 may additionally track vehicle 100's position relative to each toll station to determine if vehicle 100 has exited the toll-way 400 such that a final toll charge may be applied. Upon determining a current toll charge for the vehicle 100 (or its associated customer), telematics server 120 may send a message 415 to toll authority server 130 that includes the vehicle/customer ID, the timestamp, and the current calculated toll charge.

Upon receipt of the message 415 from telematics server 120, toll authority server 130 may engage in a transaction 420 with payment server 135 to charge the customer for the calculated toll charge sent in the message 415 from telematics server 120. Payment server 135 obtains a customer payment 425 from the customer, and sends a report 430 to toll authority server 130 verifying the customer payment for the toll charge. The report 430 may include, for example, the vehicle/customer ID and the amount of the customer payment.

Figure 6:
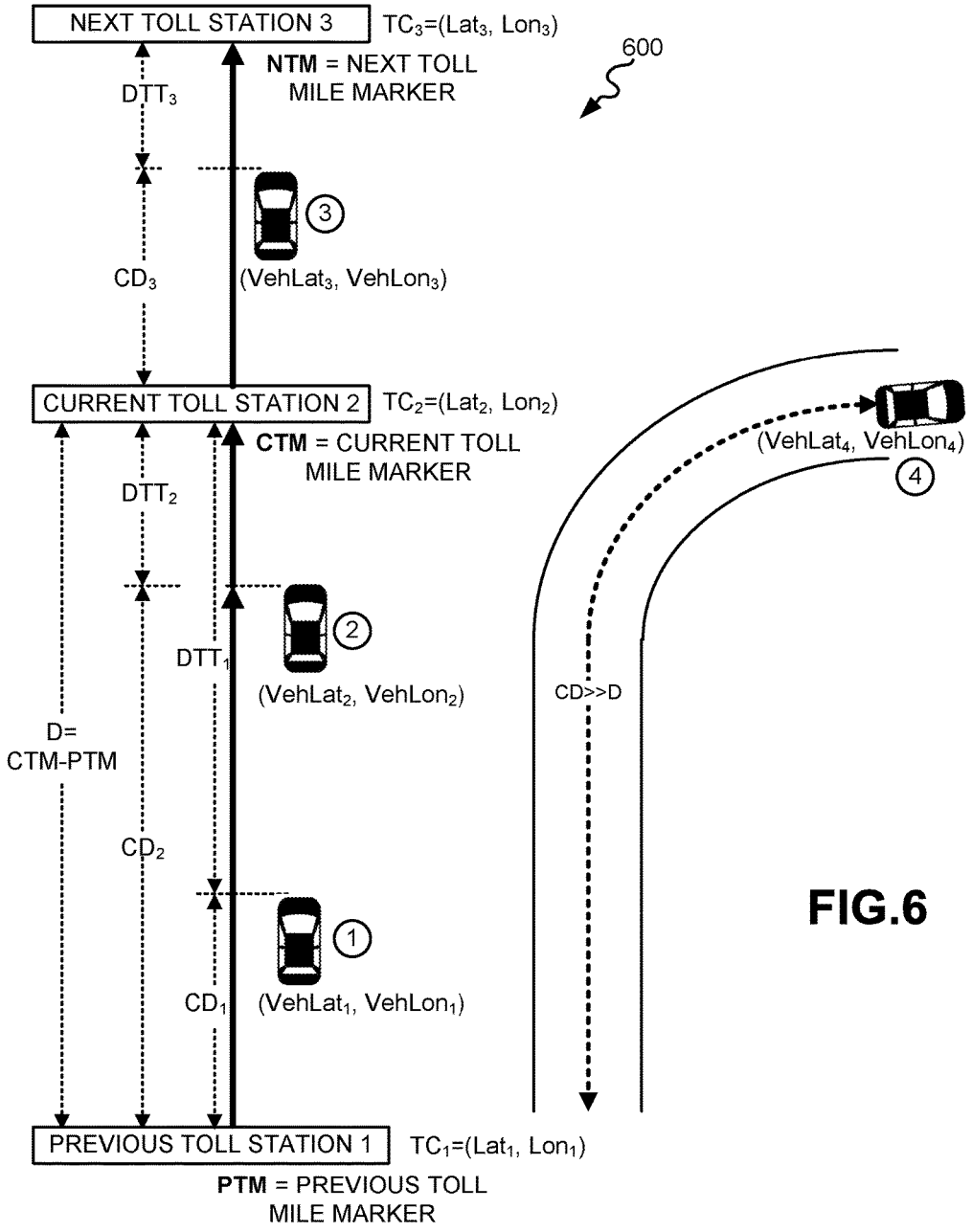
FIG. 6 depicts a vehicle transiting an exemplary portion of a toll-way during execution of the exemplary process of FIGS. 5A-5D.

FIGS. 5A-5D are flowcharts that illustrate an exemplary process for tracking a geographic position of a vehicle, comparing the position with the toll station geographic coordinates of a toll-way, and triggering vehicle toll charges based on the position comparison. In one implementation, the exemplary process of FIGS. 5A-5D may be implemented by telematics server 120. The exemplary process of FIGS. 5A-5D is described below with reference to the toll-way diagram of FIG. 6. The exemplary process of FIGS. 5A-5D may be executed for each vehicle 100 whose reported current geographic coordinates indicate that it has entered the route of a toll-way (TWR), and continues executing until the vehicle's reported geographic coordinates indicate that it has exited the toll-way.

The exemplary process includes telematics server 120 obtaining the geographic coordinates of the previous toll station, the mile marker of the previous toll station (PTM), and the name of the previous toll station (PTN) (block 500). A "previous toll station," as referred to herein, includes the toll station within a toll-way that a vehicle 100 has most recently driven by/passed through. Referring to the exemplary portion of a toll-way 600 depicted in FIG. 6, the previous toll station 1, at toll coordinates $TC_1=(Lat_1, Lon_1)$, would be the "previous toll station" for vehicle 100 at position 1 (shown with a "1" within a circle) along toll-way 600. Though not depicted in block 500, the cumulative distance value and the previous cumulative distance value (described below with respect to block 515) may be reset to zero upon execution of block 500. Therefore, the cumulative distance value and previous cumulative distance value may be initially "zeroed" when a particular vehicle 100 enters the route of a toll-way (TWR).

Telematics server 120 obtains the geographic coordinates of the current toll station, the mile marker of the current toll station (CTM), and the name of the current toll station (CTN) (block 505). A "current toll station," as referred to herein, includes a next toll station within a toll-way that a vehicle 100 is heading towards, but has not yet driven by/passed through. Referring to the exemplary portion of a toll-way 600 depicted in FIG. 6, the current toll station 2, at toll coordinates $TC_2=(Lat_2, Lon_2)$, would be the "current toll station" for vehicle 100 at position 1 along toll-way 600, since vehicle 100 has already passed by/through toll station 1 at toll coordinates $TC_1=(Lat_1, Lon_1)$. Toll station mile markers CTM and PTM are described herein for use in determining distances between a previous toll station and a current toll station. However, distances between toll stations of a toll-way may alternatively be determined using precise toll coordinates derived from, for example, manual measurements, geographic distance calculation, and/or mapping applications (e.g., Google Maps™, MapQuest™, Garmin™).

Telematics server 120 determines if a next vehicle geographic position has been received (block 510). Wireless device 105, at vehicle 100, periodically determines device 105's current geographic position (e.g., vehicle coordinates VehLat, VehLon), and transmits a report, via wireless network 115, to telematics server 120 that contains the device 105's determined current geographic position. Wireless device 105, using geo-location device 260, may determine its geographic position every, for example, 5 seconds, and transmit a corresponding report to telematics server 120. Alternatively, wireless device 105 may determine its geographic position every 2 seconds, accumulate 10 geographic position coordinates over 20 seconds, and then send a single report contained a sequence of geographic position coordinates. As previously described with respect to FIG. 4, the report transmitted from wireless device 105 may include, in addition to the current geographic coordinates, vehicle information (e.g., vehicle type, vehicle weight, number of axles, etc.), a vehicle/customer ID, and/or a timestamp associated with the time at which the current geographic position of wireless device 105 was determined. If the next vehicle geographic position has not been received (NO—block 510), then block 510 repeats until one is received.

If the next vehicle geographic position has been received (YES—block 510), then telematics server 120 determines a distance to the current toll station (DTT) using, for example, the following function (block 515):

$$DTT = HVF(\text{current vehicle coordinates, current toll station coordinates}) \quad \text{Eqn. (1)}$$

where: current vehicle coordinates=(VehLat, VehLon);
current toll station coordinates=(Lat, Lon); and
the Haversine Function (HVF) includes the following function:

$$d = 2r\arcsin\left(\sqrt{\left(\sin^2\left(\frac{\varphi_2-\varphi_1}{2}\right)+\cos\varphi_1\cos\varphi_2\sin^2\left(\frac{\lambda_2-\lambda_1}{2}\right)\right)}\right) \quad \text{Eqn. (2)}$$

where:
d is the distance between point 1 ($\varphi_1$, $\lambda_1$) and point 2 ($\varphi_2$, $\lambda_2$) on a sphere of radius r;
$\varphi_1$ is the latitude of point 1 in radians, $\varphi_1$ is VehLat converted to radians;
$\varphi_2$ is the latitude of point 2 in radians, $\varphi_2$ is Lat converted to radians;
$\lambda_1$ is the longitude of point 1 in radians, $\lambda_1$ is VehLon converted to radians; and
$\lambda_2$ is the longitude of point 2 in radians, $\lambda_2$ is Lon converted to radians.

and determines a cumulative distance (CD) using, for example, the following function:

$$CD = HVF(\text{current vehicle coordinates, previous vehicle coordinates}) + \text{previous CD} \quad \text{Eqn. (3)}$$

where: current vehicle coordinates=($VehLat_2$, $VehLon_2$),
previous vehicle coordinates=($VehLat_1$, $VehLon_1$);
previous CD is the previously calculated value of CD at the coordinates of the previous vehicle position;
$\varphi_1$ is $VehLat_1$ converted to radians;
$\varphi_2$ is $VehLat_2$ converted to radians;
$\lambda_1$ is $VehLon_1$ converted to radians; and
$\lambda_2$ is $VehLon_2$ converted to radians Referring to the example of FIG. 6, when the vehicle is at position 1 along toll-way 600, the current vehicle geographic coordinates are ($VehLat_1$, $VehLon_1$), the previous toll station coordinates are $TC_1$=($Lat_1$, $Lon_1$), and the current toll station coordinates are $TC_2$=($Lat_2$, $Lon_2$). $DTT_1$ is determined relative to current toll station 2, and $CD_1$ is determined relative to previous toll station 1. Further, when the vehicle is at position 2 along toll-way 600, the current vehicle geographic coordinates are ($VehLat_2$, $VehLon_2$), the previous toll station coordinates are $TC_1$=($Lat_1$, $Lon_1$), and the current toll station coordinates are $TC_2$=($Lat_2$, $Lon_2$). $DTT_1$ is still determined relative to current toll station 2, and $CD_1$ is also still determined relative to previous toll station 1. In other implementations, the distance calculations performed above using the Haversine function may be replaced by, or augmented with, various distance applications available from mapping providers such, as for example, Mapquest™, Google Maps™, Garmin™, etc.

Telematics server 120 determines if the current vehicle coordinates (VCC) are outside of the toll-way route (TWR) (VCC< >TWR), or if the cumulative distance (CD) is sufficiently greater than the distance between the previous toll station and the current toll station (CD>>CTM−PTM), indicating that the vehicle 100 has exited the toll-way (block 520). Telematics server 120 may maintain a set of coordinates for the route of the toll-way, from entrance to exit, such that server 120 may compare the current vehicle coordinates with the set of coordinates to identify if the vehicle 100 is no longer traveling along the route of the toll-way and, therefore, has exited the toll-way.

Additionally, telematics server 120 may determine a distance (D) between the current toll station (e.g., toll station mile marker (CTM)) and the previous toll station (e.g., toll station mile marker (PTM)) (D=CTM−PTM). Telematics server 120 may then determine if the cumulative distance CD that vehicle 100 has traveled from the previous toll station sufficiently exceeds distance D to indicate that vehicle 100 has exited the toll-way. For example, referring to FIG. 6 (right side of figure), at position 4 (shown with a "4" within a circle), the vehicle is located at the geographic coordinates VehLat4, $VehLon_4$. At these coordinates, server 120 determines that the cumulative distance CD that the vehicle has traveled is sufficiently greater than the distance D between the current toll station, and the previous toll station, that, since the vehicle has not passed by/through the current toll station, the vehicle must have exited the toll-way 600.

If it is determined that the vehicle 100 has exited the toll-way (YES—block 520), then telematics server 120 obtains the toll rate, calculates the current toll amount, and calculates the total toll amount for the toll-way (block 575). Telematics server 120 sends the ID of the vehicle and/or customer associated with the vehicle 100, the current toll station name (CTN), the current toll station coordinates, the previous toll station name (PTN), a timestamp(s), and the calculated total toll amount to the toll authority server 130 (block 580). Toll authority server 130, in conjunction with payment server 135, assesses the toll amount to the customer, as described with respect to FIG. 4 above.

If it is determined that the vehicle 100 has not exited the toll-way (NO—block 520), then telematics server 120 determines if the distance to the current toll station (DTT) is less than or equal to a specified distance of x meters (block 525). The variable x may be used to determine a close proximity to the current toll station, and may be set to a value, such as 10 meters. If the wireless device 105 is determined to be at a geographic position that is within x meters of the current toll station, then vehicle 100's position may be considered to "match" the position of the current toll station, and vehicle may subsequently be considered to have passed by/through the toll station. If DTT is not less than or equal to x meters (NO—block 525), then the exemplary process returns to block 510 to await receipt of the next vehicle position coordinates. If DTT is less than or equal to x meters (YES—block 520), then telematics server 120 identifies the current vehicle position as a toll coordinate match with the current toll station (block 530).

Telematics server 120 obtains the toll rate, calculates the current toll amount, and calculates a total toll amount (block 535). Telematics server 120 may obtain the toll rate for the toll-way from toll authority server 130, and may assess a current toll amount, for passing by/through the current toll station, to the customer associated with vehicle 100 based on the toll rate. If toll-way includes multiple toll stations along the toll-way route, and the current toll station is not the last toll station along the route, then server 120 may maintain a cumulative, total toll amount that aggregates all of the toll charges up to the current toll station. Telematics server 120 sends an ID of the vehicle 100 and/or the customer associated with the vehicle 100, the current toll station name (CTN), a current toll station coordinates, the previous toll station name (PTN), the timestamp(s), and the calculated total toll amount to the toll authority server 130 (block 540).

As described with respect to FIG. 4, toll authority server 130, upon receipt of the calculated toll amount, and other information, from telematics server 120, engages in a transaction with payment server 135 to charge the customer for the calculated toll charge received from telematics server 120. Payment server 135 obtains a payment from the customer for the specified toll charge, and sends a report to toll authority server 130 verifying the customer payment for the toll charge. The report may include, for example, the vehicle/customer ID and the amount of the customer payment.

Telematics server 120 sets the previous toll station mile marker value (PTM) to a current toll station mile marker value (CTM) (PTM=CTM) (block 545), and sets the previous toll station name (PTN) equal to the current toll station name (CTN) (PTN=CTN) (block 550). To reset the cumulative distance calculation CD from the current toll station to the next toll station, server 120 re-classifies the current station toll station as a "previous toll station." Referring to FIG. 6, once the vehicle passes by/through current toll station 2, server 120 re-classifies toll station 2 as a "previous toll station."

Telematics server 120 obtains a next toll station name (NTN) along the toll-way route, a mile marker value associated with the next toll station (NTM), and coordinates associated with the next toll station (block 555), sets the current toll station mile marker value (CTM) to the determined next toll station mile marker value (NTM (CTM=NTM) (block 560), and sets the current toll station name (CTN) to the determined next toll station name (NTN) (CTN=NTN) and the current toll station coordinates to the determined next toll station coordinates (block 565). Referring again to FIG. 6, in addition to re-classifying toll station 2 as a "previous toll station," server 120 classifies the next toll station 3 along toll-way 600, as a "current toll station" for purposes of toll tracking and cumulative distance calculation CD. Calculations of distance between toll station (CTM-PTM), distance to the current toll station DTT, and cumulative distance CD will be based on the toll stations newly re-classified as "current toll station" and "previous toll station." In the example of FIG. 6, when the vehicle is at position 3 along toll-way 600, next toll station 3 becomes the "current toll station" and current toll station 2 becomes the "previous toll station." Therefore, with the re-classification of "current" and "previous" toll station, when the exemplary process returns to blocks 510 and 515, the determination of the distance to current toll station DTT and the cumulative distance CD uses the newly re-classified "current" and "previous" toll stations.

Telematics server 120 sets the cumulated distance value (CD), and the previous CD value, equal to zero (block 570). Telematics server 120, therefore, "resets" the CD and previous CD values such that a subsequent determination(s) of DTT and CD references the newly reclassified toll stations. Referring to the example of FIG. 6, at position 3 on toll-way 600, $CD_3$ is determined relative to toll station 2 (the "previous toll station"), and $DTT_3$ is determined relative to toll station 3 (the "current toll station"). Subsequent to block 570, the exemplary process returns to block 510 to await the receipt of a report of the next vehicle position coordinates of vehicle 100 as it transits the toll-way.

The foregoing description of implementations provides illustration and description, but is not intended to be exhaustive or to limit the invention to the precise form disclosed. Modifications and variations are possible in light of the above teachings or may be acquired from practice of the invention. For example, while a series of blocks has been described with respect to FIGS. 5A-5D, and message/operation flows with respect to FIG. 4, the order of the blocks and/or message flows may be varied in other implementations. Moreover, non-dependent blocks may be performed in parallel.

Certain features described above may be implemented as "logic" or a "unit" that performs one or more functions. This logic or unit may include hardware, such as one or more processors, microprocessors, application specific integrated circuits, or field programmable gate arrays, software, or a combination of hardware and software.

No element, act, or instruction used in the description of the present application should be construed as critical or essential to the invention unless explicitly described as such. Also, as used herein, the article "a" is intended to include one or more items. Further, the phrase "based on" is intended to mean "based, at least in part, on" unless explicitly stated otherwise.

To the extent the aforementioned embodiments collect, store, or employ personal information provided by individuals, it should be understood that such information shall be used in accordance with all applicable laws concerning protection of personal information. Additionally, the collection, storage, and use of such information can be subject to consent of the individual to such activity, for example, through well known "opt-in" or "opt-out" processes as can be appropriate for the situation and type of information. Storage and use of personal information can be in an appropriately secure manner reflective of the type of information, for example, through various encryption and anonymization techniques for particularly sensitive information.

In the preceding specification, various preferred embodiments have been described with reference to the accompanying drawings. It will, however, be evident that various modifications and changes may be made thereto, and additional embodiments may be implemented, without departing from the broader scope of the invention as set forth in the claims that follow. The specification and drawings are accordingly to be regarded in an illustrative rather than restrictive sense.

What is claimed is:

1. A method, comprising:

receiving, by a network device, a vehicle coordinate report from a vehicle transiting a toll-way, wherein the report includes current geographic coordinates of the vehicle;

determining, by the network device, a location of a previous toll station of the toll-way based on the current geographic coordinates of the vehicle, wherein the previous toll station is a toll station on the toll-way that the vehicle has most recently passed;

determining, by the network device, a distance to a current toll station (DTT) of the toll-way based on the current geographic coordinates of the vehicle, wherein the current toll station is a next toll station on the toll-way that the vehicle has not yet passed;

determining, by the network device, a cumulative distance traveled by the vehicle on the toll-way based on the current geographic coordinates of the vehicle, wherein the cumulative distance is a distance between the previous toll station and the current geographic coordinates of the vehicle;

determining, by the network device, a distance between the previous toll station and the current toll station;

determining, by the network device, whether the distance between the previous toll station and the current toll station is less than the cumulative distance;

triggering, by the network device, assessment of a first toll charge to a customer associated with the vehicle when the distance between the previous toll station and the current toll station is less than the cumulative distance, wherein the first toll charge is based on the previous toll; and triggering, by the network device, assessment of a second toll charge to the customer associated with the vehicle based on the determined DTT and the cumulative distance when the distance between the previous toll station and the current toll station is not less than the cumulative distance, wherein the second toll charge is based on the current toll station.

2. The method of claim 1, further comprising:

comparing the determined DTT to a proximity value, wherein triggering the assessment of the second toll charge is based on the comparison.

3. The method of claim 2, further comprising:

identifying the current geographic coordinates of the vehicle as a coordinate match with the current toll station based on the comparison.

4. The method of claim 1, wherein the current geographic coordinates of the vehicle comprise Global Positioning System (GPS) coordinates obtained by a device associated with the vehicle and transmitted to the network device via wireless mechanisms.

5. The method of claim 1, further comprising:

obtaining geographic coordinates of the current toll station of the toll-way; and obtaining geographic coordinates of the previous toll station of the toll-way.

6. The method of claim 5, wherein the current geographic coordinates of the vehicle comprise ($VehLat_2$, $VehLon_2$), wherein the current toll station of the toll-way has geographic coordinates ($Lat_2$, $Lon_2$), and wherein the DTT is determined by applying a Haversine Formula to the current geographic coordinates ($VehLat_2$, $VehLon_2$) and the current toll station geographic coordinates ($Lat_2$, $Lon_2$).

7. The method of claim 6, further comprising:

receiving, by the network device, a previous vehicle coordinate report from the vehicle transiting the toll-way, wherein the previous report includes the previous geographic coordinates of the vehicle, wherein the previous geographic coordinates of the vehicle comprise ($VehLat_1$, $VehLon_1$), and wherein the cumulative distance is determined by applying the Haversine Formula to the current geographic coordinates ($VehLat_2$, $VehLon_2$) and the previous geographic coordinates ($VehLat_1$, $VehLon_1$) of the vehicle.

8. The method of claim 1, further comprising setting the current toll station as the previous toll station in response to triggering assessment of the second toll.

9. A network device, comprising:

a wireless communication interface connected to a wireless network and configured to receive a vehicle coordinate report from a vehicle transiting a toll-way, wherein the vehicle coordinate report includes current geographic coordinates of the vehicle; and a processor configured to:

determine a location of a previous toll station of the toll-way based on the current geographic coordinates of the vehicle, wherein the previous toll station is a toll station on the toll-way that the vehicle has most recently passed;

determine a distance to a current toll station (DTT) of the toll-way based on the current geographic coordinates of the vehicle, wherein the current toll station is a next toll station on the toll-way that the vehicle has not yet passed, determine a cumulative distance traveled by the vehicle on the toll-way based on the current geographic coordinates of the vehicle, wherein the cumulative distance is a distance between the previous toll station and the current geographic coordinates of the vehicle, determine a distance between the previous toll station and the current toll station, determine whether the distance between the previous toll station and the current toll station is less than the cumulative distance, trigger assessment of a first toll charge to a customer associated with the vehicle when the distance between the previous toll station and the current toll station is less than the cumulative distance, wherein the first toll charge is based on the previous toll, and trigger assessment of a second toll charge to the customer associated with the vehicle based on the determined DTT and the cumulative distance when the distance between the previous toll station and the current toll station is not less than the cumulative distance, wherein the second toll charge is based on the current toll station.

10. The network device of claim 9, wherein the processor is further configured to:

compare the determined DTT to a proximity value, wherein triggering the assessment of the second toll charge is based on the comparison.

11. The network device of claim 10, wherein the processor is further configured to:

identify the current geographic coordinates of the vehicle as a coordinate match with the current toll station based on the comparison.

12. The network device of claim 9, wherein the processor is further configured to:

obtain geographic coordinates of the current toll station of the toll-way; and obtain geographic coordinates of a previous toll station of the toll-way.

13. The network device of claim 9, wherein the current geographic coordinates of the vehicle comprise ($VehLat_2$, $VehLon_2$), wherein the current toll station of the toll-way has geographic coordinates ($Lat_2$, $Lon_2$), and wherein the DTT is determined by applying a Haversine Formula to the current geographic coordinates ($VehLat_2$, $VehLon_2$) and the current toll station geographic coordinates ($Lat_2$, $Lon_2$), and wherein the communication interface is further configured to receive a previous vehicle coordinate report from the vehicle transiting the toll-way, wherein the previous report includes the previous geographic coordinates of the vehicle, wherein the previous geographic coordinates of the vehicle comprise ($VehLat_1$, $VehLon_1$), and wherein the cumulative distance is determined by applying the Haversine Formula to the current geographic coordinates ($VehLat_2$, $VehLon_2$) and the previous geographic coordinates ($VehLat_1$, $VehLon_1$) of the vehicle.

14. The network device of claim 9, wherein the processor is further configured to set the current toll station as the previous toll station in response to triggering assessment of the second toll.

15. A non-transitory storage medium storing instructions executable by a device, wherein the instructions comprise instructions to cause the device to:

receive a vehicle coordinate report from a vehicle transiting a toll-way, wherein the report includes current geographic coordinates of the vehicle;

determine a location of a previous toll station of the toll-way based on the current geographic coordinates of the vehicle, wherein the previous toll station is a toll station on the toll-way that the vehicle has most recently passed;

determine a distance to a current toll station (DTT) of the toll-way based on the current geographic coordinates of the vehicle, wherein the current toll station is a next toll station on the toll-way that the vehicle has not yet passed;

determine a cumulative distance traveled by the vehicle on the toll-way based on the current geographic coordinates of the vehicle, wherein the cumulative distance is a distance between the previous toll station and the current geographic coordinates of the vehicle;

determine a distance between the previous toll station and the current toll station;

determine whether the distance between the previous toll station and the current toll station is less than the cumulative distance;

trigger assessment of a first toll charge to a customer associated with the vehicle when the distance between the previous toll station and the current toll station is less than the cumulative distance, wherein the first toll charge is based on the previous toll; and trigger assessment of a second toll charge to a customer associated with the vehicle based on the determined DTT and the cumulative distance when the distance between the previous toll station and the current toll station is not less than the cumulative distance, wherein the second toll charge is based on the current toll station.

16. The non-transitory storage medium of claim 15, wherein the instructions comprise instructions to cause the device to:

compare the determined DTT to a proximity value, wherein triggering the assessment of the second toll charge is based on the comparison.

17. The non-transitory storage medium of claim 16, wherein the instructions comprise instructions to cause the device to:

identify the current geographic coordinates of the vehicle as a coordinate match with the current toll station based on the comparison.

18. The non-transitory storage medium of claim 15, wherein the current geographic coordinates of the vehicle comprise ($VehLat_2$, $VehLon_2$), wherein the current toll station of the toll-way has geographic coordinates ($Lat_2$, $Lon_2$), and wherein the DTT is determined by applying a Haversine Formula to the current geographic coordinates ($VehLat_2$, $VehLon_2$) and the current toll station geographic coordinates ($Lat_2$, $Lon_2$).

19. The non-transitory storage medium of claim 18, wherein the instructions comprise instructions to cause the device to:

receive a previous vehicle coordinate report from the vehicle transiting the toll-way, wherein the previous report includes the previous geographic coordinates of the vehicle, wherein the previous geographic coordinates of the vehicle comprise ($VehLat_1$, $VehLon_1$), and wherein the cumulative distance is determined by applying the Haversine Formula to the current geographic coordinates ($VehLat_2$, $VehLon_2$) and the previous geographic coordinates ($VehLat_1$, $VehLon_1$) of the vehicle.

20. The non-transitory storage medium of claim 15, wherein the instructions comprise instructions to cause the device to set the current toll station as the previous toll station in response to triggering assessment of the second toll.

* * * * *